United States Patent [19]

Howard

[11] 4,236,548

[45] Dec. 2, 1980

[54] APPARATUS FOR PROVIDING INSTANT HOT WATER

[76] Inventor: E. W. Howard, 1221 S. Wood Dr., Okmulgee, Okla. 74447

[21] Appl. No.: 44,455

[22] Filed: Jun. 1, 1979

[51] Int. Cl.[3] ..... F24H 1/10; F24H 1/14

[52] U.S. Cl. ..... 137/335; 126/361; 137/341; 219/309; 200/81.9 R

[58] Field of Search ..... 126/361; 137/335, 341; 219/309, 332, 496; 200/81.9

[56] References Cited

U.S. PATENT DOCUMENTS

| | | | |
|---|---|---|---|
| 1,351,779 | 9/1920 | Mather | 219/309 |
| 1,888,737 | 11/1932 | Richmond | 200/81.9 R |
| 3,963,889 | 6/1976 | Stonich | 200/81.9 R |

FOREIGN PATENT DOCUMENTS

| | | | |
|---|---|---|---|
| 1222569 | 8/1966 | Fed. Rep. of Germany | 200/81.9 R |

*Primary Examiner*—Gerald A. Michalsky
*Attorney, Agent, or Firm*—William S. Dorman

[57] ABSTRACT

A control system for providing instant hot water at a hot water tap comprising a control unit adapted to be interposed in the fluid line between the source of water supply and the hot water tap. A heating unit is also interposed in the fluid line between the control unit and the hot water tap. The heating unit includes a closed heating chamber, a pipe arranged within the chamber and comprising a portion of the fluid line between the control unit and the hot water tap. A heating means is provided within the heating chamber for heating the pipe. The control unit comprises a fluid passageway therethrough constituting a portion of the fluid line between the source of supply and the heating unit. A flapper chamber is formed in the passageway and an inlet pipe from the source of supply has an inlet end disposed within the flapper chamber. A flapper is pivotally mounted within the flapper chamber and disposed over the inlet end of the pipe when there is no water passing through the control unit. The flapper chamber is provided with a flat surface which is disposed within the swinging path of movement of the flapper, which swinging path of movement is determined by the movement of the flapper when caused to move by the passage of water through the control unit. A diaphragm is received within an opening in the flat surface and is adapted to be contacted by a nose on the flapper when water is passing through the unit. Externally of the flapper chamber, the diaphragm is provided with an outwardly projecting finger which is adapted to engage an electrical means mounted within the control unit adjacent a diaphragm and externally of the flapper chamber. When the finger contacts the electrical means, the electrical means is energized to activate the heating means.

3 Claims, 8 Drawing Figures

APPARATUS FOR PROVIDING INSTANT HOT WATER

BACKGROUND OF THE INVENTION

1. Field of the Invention

The present invention relates to an apparatus for providing hot water and, more particularly, to an apparatus for providing instant hot water at a hot water tap in response to the opening of the hot water tap.

2. Description of the Prior Art

Systems and devices have been provided in the past for supplying instant hot water. However, the present invention is considered to be much simpler and less expensive than those provided by the prior art in that the present invention is specifically designed for use in connection with a single motel room or unit or for a single family dwelling utilizing relatively simple and inexpensive components.

SUMMARY OF THE INVENTION

The present invention involves an apparatus for providing instant hot water at a hot water tap within a motel unit or within a single family dwelling in response to the mere opening of a tap itself; that is, the running of water out of the hot water tap actuates a control unit which is disposed in the fluid line between the source of supply of water and the hot water tap. A heating unit is also located in the fluid line between the control unit and the hot water tap. The heating unit comprises a closed heating chamber and a pipe, generally arranged in a serpentine fashion and constituting a portion of the fluid line between the control unit and the hot water tap. In one form of the invention the heating unit is gas operated which means that the serpentine pipe which must be made of material to withstand the rigors of gas heating is disposed within the heating chamber over one or more gas burners. In another form of the invention the heating unit is electrically operated in which case the serpentine pipe is preferably made of copper and elongated heating elements are disposed within elongated horizontal tubes of the serpentine structure. The control unit can be a relatively small box or chamber which includes a fluid passageway that constitutes a portion of the fluid line between the supply and the heating unit. Part of the fluid passageway in the control unit is defined as a flapper chamber and the inlet end of the pipe which connects with the supply is disposed within the flapper chamber. A pivotally mounted flapper is mounted in the flapper chamber and is disposed over the inlet end of the inlet pipe when there is no water passing through the control unit. A flat surface is disposed on the flapper chamber within the swinging path of movement of the flapper. A circular diaphragm is mounted within an opening in the flat surface on the flapper chamber. A button or nose is provided on the flapper and this nose contacts the approximate center of the diaphragm when the flapper is caused to swing outwardly away from the inlet pipe in response to the movement or passage of water through the control unit. Externally of the flapper chamber, the diaphragm is provided with an outwardly projecting button or finger which is adapted to contact and energize an electrical system mounted within the control unit. This electrical system briefly involves a pair of contacts disposed adjacent the diaphragm, a contact bar which is mounted on a plunger, the plunger being in the position to be contacted by the finger on the diaphragm. When the finger on the diaphragm contacts the plunger, the contact bar completes the circuit between the two contacts and thus energizes an electrical circuit within an electrical control box which is mounted on the control unit. The electrical control box will be provided with conventional means which will operate, for example, an electrical solenoid valve which provides instant gas to the gas burners; alternatively, the electrical control box will be provided with the required circuitry for supplying the proper electrical current and/or voltage to the electrical heating system.

DETAILED DESCRIPTION OF THE PREFERRED EMBODIMENTS

Figure 1:
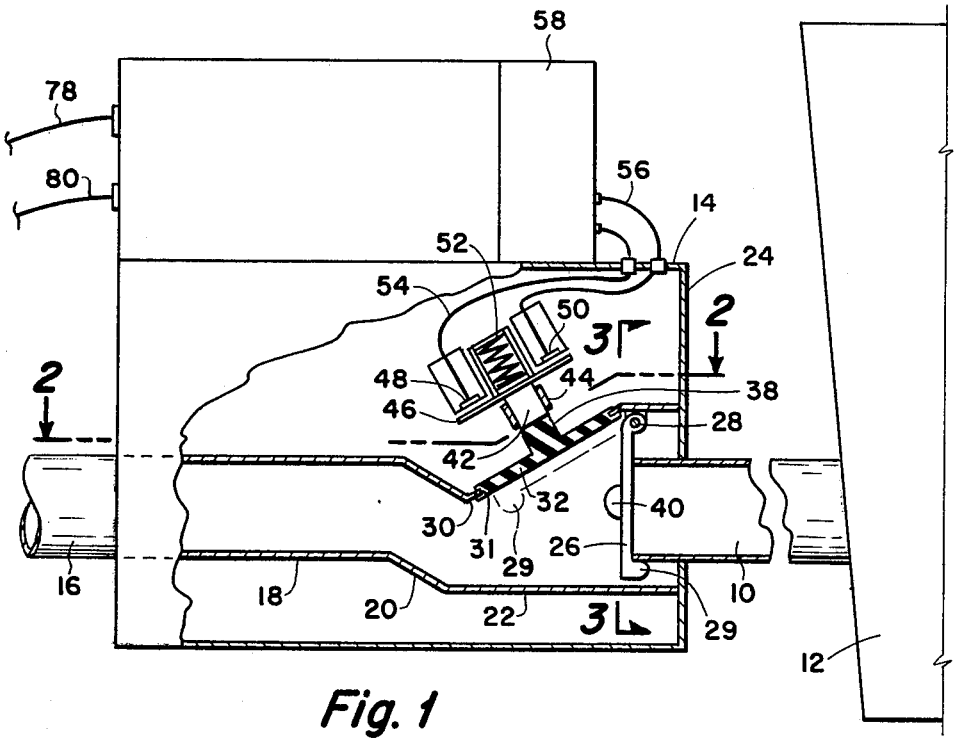
FIG. 1 is a side elevation, partly diagrammatic and partly in section, of the control unit forming a portion of the present invention.
Figure 2:
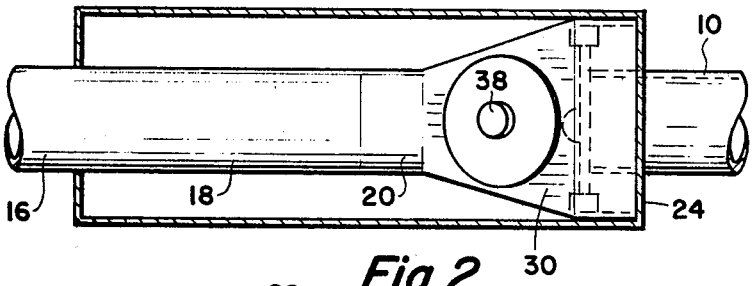
FIG. 2 is a sectional view taken along section line 2—2 of FIG. 1.
Figure 3:
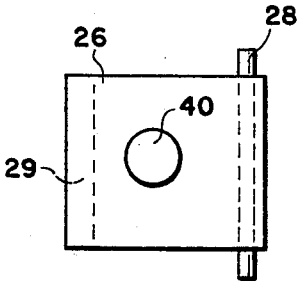
FIG. 3 is a view of the left hand side of the flapper taken along section line 3—3 of FIG. 1.

Referring to the drawings in detail, FIG. 1 shows an inlet line 10 which conducts water into the system of the present invention and which ultimately, as will hereinafter appear, after it passes through the control system and heating system of the present invention, will lead to one or more hot water taps or outlets (not shown) in a house or motel unit. Thus, the opening of a hot water faucet or tap at the house or motel unit will activate the system of the present invention to provide instant hot water.

The inlet line 10 can connect directly with a cold water main or supply (not shown) or it can connect indirectly to the main or supply through a conventional water filter diagrammatically indicated at 12. Water from the inlet line 10 passes into a control unit 14 of the present invention, later to be described in greater detail. Water from the unit 14 passes out through the pipe 16 and thence to either of the two heating systems shown in FIGS. 5 and 6 or 7 and 8.

The unit 14 includes a pipe portion 18 to the left which merges with (or is part of) the outlet pipe 16. At the right hand end of the pipe portion 18 there is an inclined and downwardly directed throat portion 20 which connects with a flapper chamber 22. The right hand end of the flapper chamber 22 connects in a watertight manner with a plate 24 which forms the right hand end of the unit 14. The pipe 10 is also connected to the plate 24 in a watertight manner. A flapper 26 having a shaft horizontal 28 is pivotally mounted within the chamber 22 immediately at the left hand end of the pipe 10 so as to cover over the end of the pipe 10 as it appears in FIG. 1. The lower end of the flapper is provided with a thickened portion or lip 29 which is directed towards the right and which serves as added weight to return the flapper to its solid line position shown in FIG. 1. The lip also serves an additional function which will be explained below.

Figure 4:
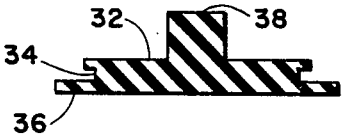
FIG. 4 is a cross-sectional view, on a slightly enlarged scale, of the diaphragm shown in FIGS. 1 and 2.

The right hand end of the flapper chamber 22 is somewhat boxlike in shape and is preferably, but not necessarily, rectangular where it attaches to the plate 24. The chamber 22 is provided with a flat surface 30 to the left and above the flapper 26. This flat surface 30 is provided with an opening 31 in which a flxible disc or diaphragm 32 is received. The flexible disc can be made out of rubber, plastic, possibly neoprene, or other suitable material. As best shown in FIG. 4, which is a cross-section through the diaphragm, this member 32 is provided with a groove 34 which fits around the openings 31, and a flat peripheral flange 36 which bears against the inside surface of the flat portion 30. The diaphragm or disc 32 is also provided with a central outwardly projection finger or button 38, the purpose of which will hereinafter appear. Similarly, the flapper 26 is provided with an outwardly projecting nose or button 40 which, when the flapper swings to the dotted line position shown in FIG. 1, is adapted to bear against the inner surface of the diaphragm 32 in a position opposite from the finger 38 so as to move the finger outwardly away from the surface 30 when the flapper 26 is in the fully opened position.

Immediately above the finger 38 shown in FIG. 1 is a non-conducting cylindrical plunger 42 which is slidably received within a sleeve 44. The upper or outer end of the plunger 42 connects with a contact bar 46 which, when urged upwardly or outwardly by the finger 38 is adapted to complete an electrical circuit between a pair of contacts 48 and 50, diagrammatically illustrated for the sake of simplicity. A spring 52, suitably insulated, is disposed between the two contacts 48 and 50 and is adapted to push the contact bar 46 away from the contacts when the finger 38 is in its retracted or relaxed position. A pair of leads 54 and 56 connect from the contacts 48 and 50, respectively, to a control box 58 which includes relays, switches, etc., the details of which are considered to be conventional and hence are not shown. It should be pointed out, however, that the control box 58 contains circuitry to operate the electrical hot water heating system of FIGS. 5 and 6, or the gas hot water heating system of FIGS. 7 and 8.

Figure 5:
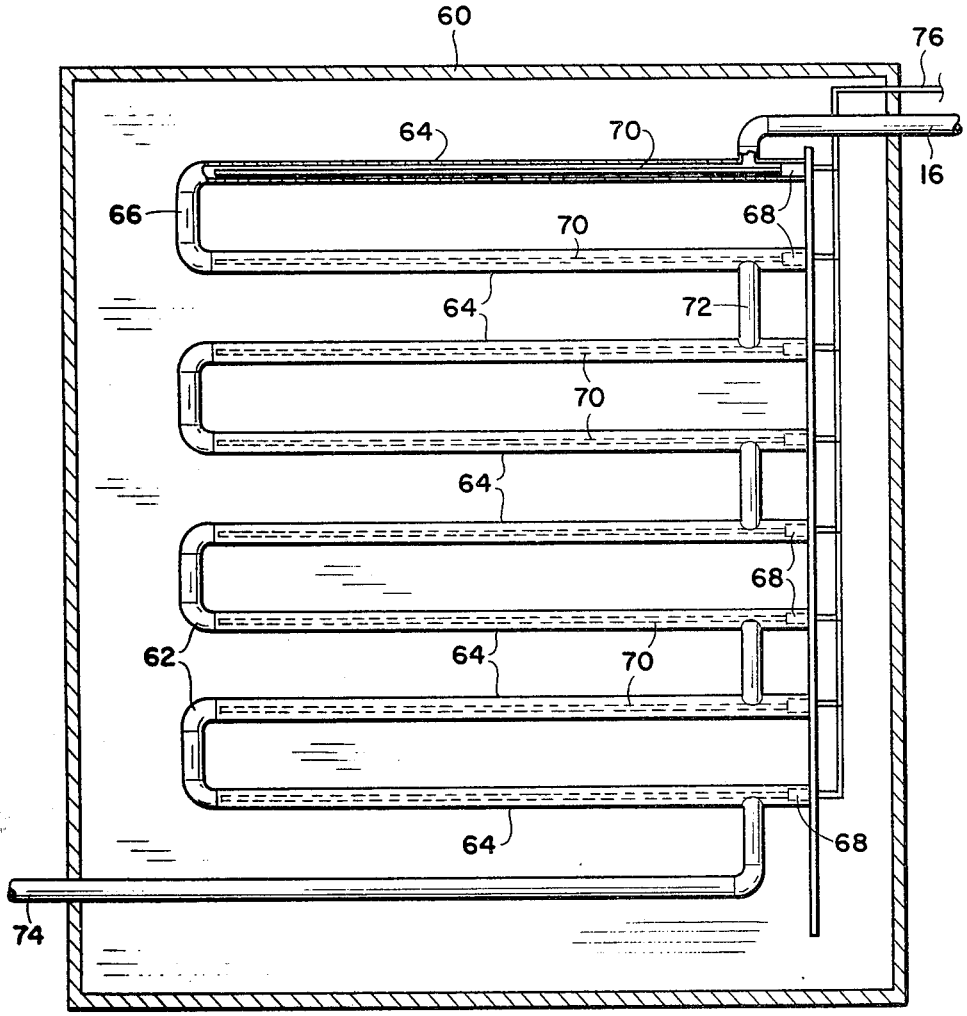
FIG. 5 is a horizontal sectional view through one form of heating means employed in the present invention.
Figure 6:
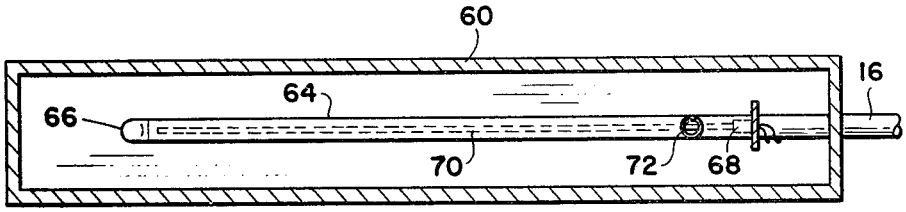
FIG. 6 is a vertical sectional view through the heating chamber shown in FIG. 5.

Turning now to consideration of FIGS. 5 and 6, the pipe 16 is shown as connecting with a rectangular chamber 60 in which a plurality of pipes 62 are arranged in serpentine fashion. The pipes within the chamber 60 are preferably made of copper or other metal compatible with electrical heating means. The interior of the chamber 60 is also preferably filled with insulating material (not shown). The serpentine arrangement 62 includes a plurality of horizontal (copper) tubes 64 connected at their left hand ends with short U-bends 66. A plug 68 is received in the right hand end of each of the longitudinal tubes 64 and an electrical heating element such as a "Calrod" unit 70 extends through an opening in the plug 68 and for essentially the entire longitudinal distance of each pipe 64. Each heating rod 70 is preferably centrally disposed within each pipe 64 so as to be spaced away from the walls thereof. Each plug 68 and each heating rod that passes therethrough is mounted and sealed in relation to each pipe section 64 so as to provide a watertight and pressuretight connection at the right hand end of each pipe 64. The alternate pairs of horizontal pipes 64 are connected by short vertical pipes or tubes 72 as shown so as to provide a continuous path for the water to pass from the inlet pipe 16 to an outlet pipe 74. An electrical conduit diagrammatically indicated by the reference numeral 76 supplies the proper electrical current and/or voltage to operate the heating elements 70. The other end of the electrical conduit 76 connects with leads 78 and 80 which represent the electrical output from the control box 58. It should be understood, of course, that the electrical circuitry within the control box 58 will vary depending upon whether the invention employs the electrical heater shown in FIGS. 5 and 6 or the gas heater shown in FIGS. 7 and 8. In the case of FIGS. 5 and 6 the output leads 78 and 80 from the control box 58 will merely represent the required electrical power to operate the units 70. In the event that the gas units of FIGS. 5 and 6 are employed, the leads 78 and 80 will provide the proper electrical power to operate a conventional solenoid which turns on the gas for the burners, later to be described, shown in FIGS. 7 and 8.

Figure 7:
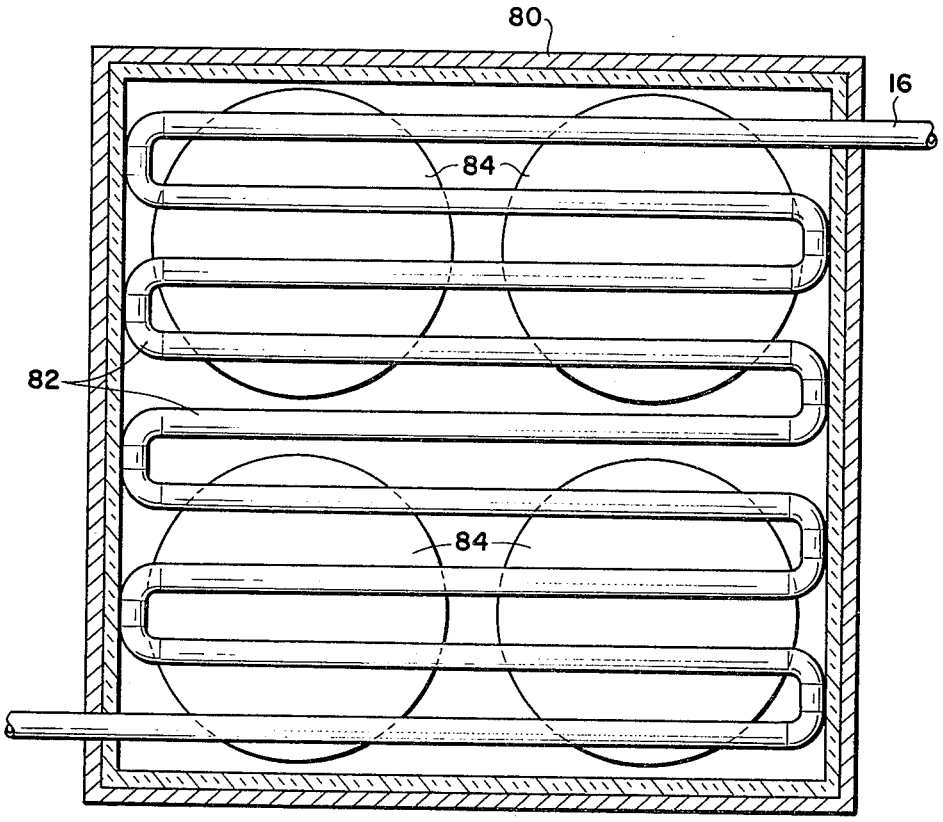
FIG. 7 is a horizontal sectional view through another form of heating chamber employed in the present invention.
Figure 8:
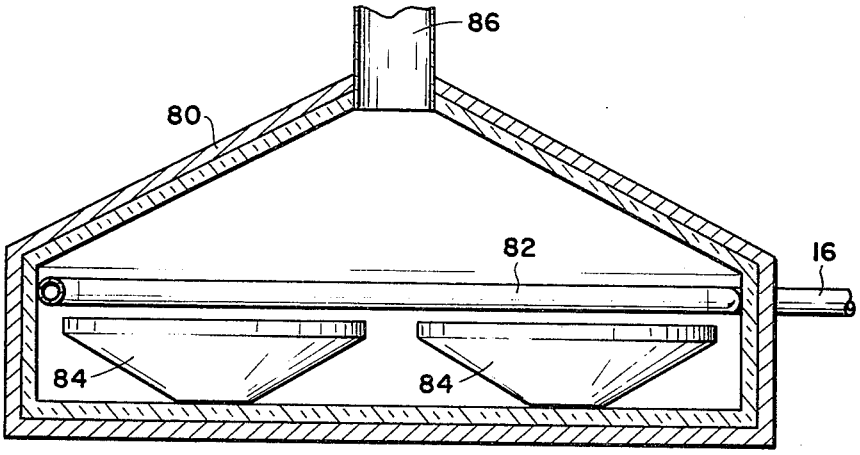
FIG. 8 is a vertical sectional view through the heating chamber shown in FIG. 7.

Turning now to a consideration of FIGS. 7 and 8, the output pipe 16 from the unit 14 is shown as leading into a chamber 80 which includes a plurality of pipes 82 also arranged in serpentine fashion over a plurality of gas burners 84. In the case of the gas heater shown in FIGS. 7 and 8, the pipes 82 must be constructed of such material, such as tungsten-type steel, as to be able to withstand the conditions imposed upon this pipe by the gas burners 84. A suitable outlet pipe 86 will lead to a flue or exhaust (not shown) which could be a fan or merely the atmosphere itself. The details of the operation of the gas burners 84 is deemed to be conventional and, hence, is not shown. It is believed that it is sufficient to state that the operation of a gas burner by means of an electrical solenoid valve is well known. In this regard, the electrical conduits 78 and 80 would be connected to such a solenoid valve (not shown) to operate the valve to cause the burners 84 to be fully operative instantly whereby the water passing through the pipe 82 would be heated instantly. A conventional pilot light system (not shown) will be employed with the gas burners 84 to turn them "on" as soon as gas is supplied thereto from the gas line (not shown) which is operated by the solenoid valve (not shown) described above.

Assuming that the control system 14 is installed in the fluid line between the supply and the hot water tap (not shown), and further assuming that a heater such as shown in FIGS. 5 and 6 or as shown in FIGS. 7 and 8 is operatively installed in the fluid line between the control unit 14 and the water tap, when the water tap is opened to call for a supply of hot water, the water passing through the pipe 10 will cause the flapper to pivot about the horizontal axis 28 to the dotted line position shown in FIG. 1. As a consequence of this pivotal movement of the flapper 26, the center of the diaphragm 32 will be depressed upwardly such that the finger 38 will push against the plunger 42, thereby causing the contact plate 46 to complete the circuit between contacts 48 and 50. When the circuit between contacts 48 and 50 is completed, internal circuitry (not shown) within the electrical control box 58 will immediately energize a solenoid valve (not shown) to open the gas supply (not shown) to the burners 84 in the heating unit shown in FIGS. 7 and 8; alternatively, if the heating system of FIGS. 5 and 6 is employed, the connection between contacts 48 and 50 will cause the internal circuitry (not shown) within the electrical control unit 58 to supply the proper current and/ or voltage to instantly heat the heating elements 70 within the pipes 64. Thus, within a matter of seconds from the time that the hot water tap (not shown) is opened, hot water will issue forth from this tap.

During the period of time that the tap is open, the flapper 26 will remain in the dotted line position shown in FIG. 1. Furthermore, the force of water against the inside of the lip 29 (as shown in the dotted line position) will tend to retain the flapper 26 in the dotted line position. As soon as the hot water tap (not shown) is closed, water will cease to flow through the control unit 14 and the flapper 26 will return to the solid line position shown in FIG. 1. The spring 52 will exert a downward force against the contact bar 46 causng it to move away from the contacts 48 and 50 and therefore interrupting the circuit which was provided within the electrical control unit 58 thereby turning off the gas for the gas heater of FIGS. 7 and 8, or turning off the electrical current and/or voltage for the heating system of FIGS. 5 and 6. The spring 52, through the plunger 42, the finger 38, and the diaphragm 32 will exert a downward force against the nose 40 so as to assist in moving the flapper 26 away from the dotted line position shown in FIG. 1.

Whereas the present invention has been described in terms of a flapper which is mounted for swinging movement around a horizontal axis 28, if, for any reason, it becomes necessary or desirable to mount the flapper so that it will pivot on a vertical axis, additional spring means (not shown) can be provided to return the flapper to its relaxed position over the end of the pipe 10 when the water is no longer flowing through the unit 14; a slight modification of the plunger 42, contact bar 46 and contacts 48 and 50 may be necessary, all within the skill of the art, when the flapper 26 is mounted for pivotal movement around a vertical axis.

The control unit 14 can be made out of metal except for those portions such as the diaphragm 32, previously described, or the electrical components and controls therefor previously described; that is, the pipe portion 18, the throat 20, the flapper chamber 22, the flapper 26, the plate 24 and the outside of the box which makes up the unit 14 can be made of metal; alternatively these components mentioned immediately above can be made of plastic providing the plastic material is capable of withstanding the normal pressures associated with a conventional water supply and, further provided, that the connections with the inlet pipe 10 and the outlet pipe 16 can be watertight.

Whereas the present invention has been described in particular relation to the drawings attached hereto, it should be understood that other and further modifications, apart from those shown or suggested herein, may be made within the spirit and scope of this invention.

What is claimed is:

1. A control system for providing instant hot water at a hot water tap comprising a control unit adapted to be interposed in the fluid line between the source of water supply and the hot water tap and a heating unit interposed in said fluid line between the control unit and the hot water tap; said heating unit comprising a closed heating chamber, a pipe arranged within said chamber and constituting a portion of the fluid line between the control unit and the hot water tap, and heating means within said heating chamber for heating said pipe; said control unit comprising a fluid passageway therethrough constituting a portion of the fluid line between the source of supply and the heating unit, a flapper chamber formed in said passageway, an inlet pipe from said source of supply having an inlet end disposed within said flapper chamber, a flapper pivotally mounted in said flapper chamber, and disposed over the inlet end of said inlet pipe when no water is passing through said control unit, a flat surface on said flapper chamber disposed within the swinging path of movement of said flapper when caused to move by the passage of water through said control unit, a diaphragm received within an opening in said flat surface and adapted to be contacted by said flapper when water is passing through said unit, electrical means mounted within said control unit adjacent said diaphragm and external of said flapper chamber, said electrical means being energized by said diaphragm when said diaphragm is contacted by said flapper, said heating means being activated in response to the energizing of said electrical means.

2. A control system as set forth in claim 1 wherein said flapper is mounted for pivotal movement around a substantially horizontal axis and wherein said flapper returns by gravity to its position over the end of said inlet pipe when the passage of water is discontinued through said control unit.

3. A control system as set forth in claim 2 wherein said flapper is provided with a nose projecting out of the surface of said flapper opposite from the side thereof which is disposed over said open end of said pipe, said nose being adapted to engage said diaphragm adjacent the center thereof when water is passing through said control unit, said diaphragm being provided with an outwardly projecting finger on the opposite side of said diaphragm from said flapper, said finger being adapted to engage and energize said electrical means when water is passing through said control unit.

* * * * *